United States Patent [19]

Fitzmayer et al.

[11] Patent Number: 4,642,435

[45] Date of Patent: Feb. 10, 1987

[54] ROTATING SLOT ANTENNA ARRANGEMENT FOR MICROWAVE OVEN

[75] Inventors: Louis H. Fitzmayer; James E. Staats; Matthew S. Miller, all of Louisville, Ky.

[73] Assignee: General Electric Company, Louisville, Ky.

[21] Appl. No.: 813,638

[22] Filed: Dec. 26, 1985

[51] Int. Cl.[4] ..... H05B 6/72

[52] U.S. Cl. ..... 219/10.55 F

[58] Field of Search ..... 219/10.55 F, 10.55 A, 219/10.55 R, 10.55 E

[56] References Cited

U.S. PATENT DOCUMENTS

| | | | |
|---|---|---|---|
| 3,746,823 | 7/1973 | Whiteley et al. | 219/10.55 F |
| 3,872,276 | 3/1975 | Corcoran et al. | 219/10.55 F |
| 4,092,513 | 5/1978 | Rasmussen | 219/10.55 F |
| 4,327,266 | 4/1982 | Austin et al. | 219/10.55 F |
| 4,342,896 | 8/1982 | Teich | 219/10.55 F |
| 4,412,117 | 10/1983 | Dudley et al. | 219/10.55 F |
| 4,424,430 | 1/1984 | Almgren et al. | 219/10.55 F |
| 4,430,538 | 2/1984 | Suzuki et al. | 219/10.55 F |
| 4,430,539 | 2/1984 | Suzuki et al. | 219/10.55 F |
| 4,431,889 | 2/1984 | Saponara et al. | 219/10.55 F |
| 4,463,239 | 7/1984 | Miller | 219/10.55 F |
| 4,477,706 | 10/1984 | Mittelsteadt | 219/10.55 B |
| 4,486,639 | 12/1984 | Mittelsteadt | 219/10.55 B |

*Primary Examiner*—Philip H. Leung

*Attorney, Agent, or Firm*—H. Neil Houser; Radford M. Reams

[57] ABSTRACT

An improved excitation system for a microwave oven employing a circular rotating disk antenna configured to radiate peripherally from its outermost edge to provide backgound radiation in the oven cavity. Primary microwave energy radiation is emitted from a pair of transverse radiating slots formed in the disk antenna. A first slot is positioned radially outwardly relative to the second slot. The first slot alternately functions as a relatively strongly coupled series and shunt radiating slot and the second slot concurrently alternately functions as a moderately coupled shunt and series slot with each quarter revolution of the disk antenna. Both slots are louvered for improved coupling to the load being heated in the cavity.

11 Claims, 5 Drawing Figures

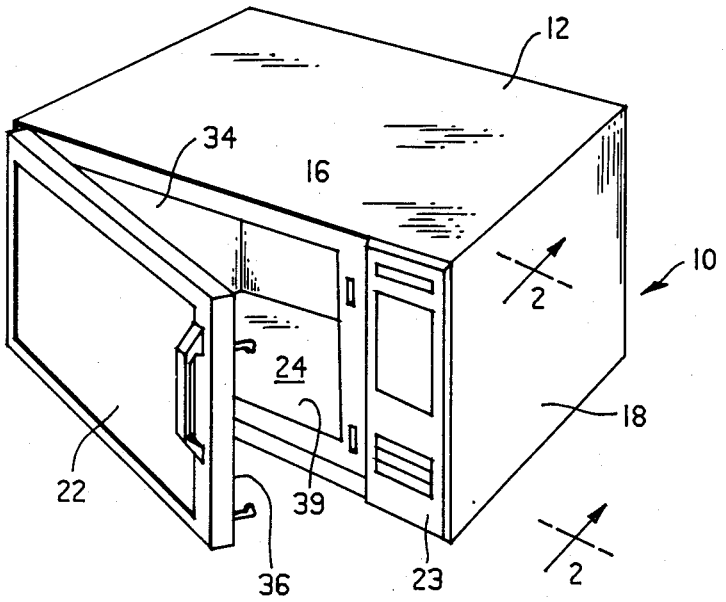
FIG. 1
FIG. 5
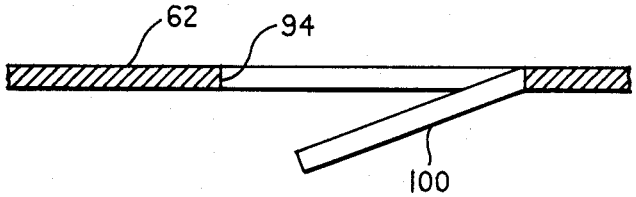
FIG. 4
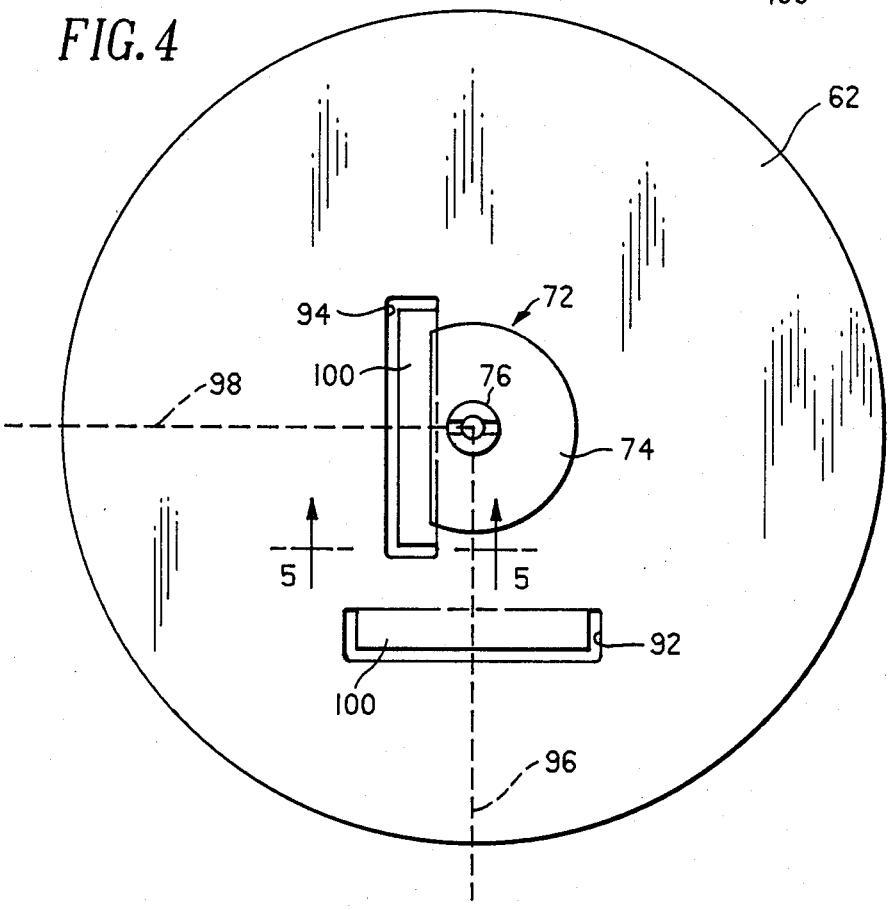

ROTATING SLOT ANTENNA ARRANGEMENT FOR MICROWAVE OVEN

BACKGROUND OF THE INVENTION

The present invention relates to a microwave cooking oven, and more specifically to an improved excitation system for such an oven which enhances the time averaged uniformity of energy distribution in the cavity.

A continuing problem in the design of microwave oven excitation systems is to eliminate hot and cold spots in the cooking cavity resulting from the non-uniform spatial distribution of energy in the cavity. A number of different approaches to this problem have been disclosed in the prior art. One approach disclosed in commonly assigned U.S. Pat. No. 4,463,239 to Miller provides an efficient low profile excitation system which effectively provides good time averaged uniformity of energy distribution in the cooking cavity configuration for which it was designed. However, in applying this teaching to a relatively elongated cavity, cooking performance was somewhat degraded.

The present invention is an improvement over the system disclosed in the Miller patent which retains the relative simplicity and low profile, characteristic of the Miller structure, while providing improved cooking performance in an elongated cooking cavity.

SUMMARY OF THE INVENTION

In accordance with the present invention, a microwave oven having a cooking cavity of the resonant type comprising a generally rectangular elongated enclosure defined by conductive walls is provided with an improved excitation system for enhancing time averaged uniformity of energy distribution within the cavity. A rectangular waveguide extending generally centrally along the upper wall of the cavity couples energy from the magnetron to the cooking cavity. A circular opening is formed in a common wall between the waveguide and the cooking cavity laterally centrally located relative to the cavity walls, which opening is essentially blocked by a rotatably mounted metallic circular radiating disk antenna which overlaps the opening on the cavity side of the common wall. The disk antenna is configured to radiate peripherally from its outermost edge into the cavity to provide background radiation to enhance the uniformity of the energy distribution of the cavity. In a preferred form of the invention the diameter of the disk antenna is on the order of $1\frac{1}{2}$ to 2 free space wave lengths.

The primary energy radiating mechanism is provided in the form of a pair of transverse radiating slots formed in the disk antenna. A first one of the slots is oriented substantially transverse to a first radial line extending from the axis of rotation of the disk antenna. The second one of the slots is oriented transverse to a second radial line extending from the axis of rotation at an angle of 90° relative to the first radial line. The first slot is radially positioned outwardly of said second slot. The first and second slots are oriented to function as series and shunt slots respectively when the first slot is aligned perpendicular to the longitudinal axis of the waveguide. The first and second slots function as shunt and series slots respectively when the first slot is aligned parallel to the longitudinal axis of the waveguide. The first slot is radially positioned to be strongly coupled to the energy propagating in the waveguide due to its travel path passing through strong coupling points with each quarter revolution of the disk. The strong coupling points are established by locating the axis of rotation approximately an integral number of half guide wave lengths from the short circuit termination of the waveguide. The second slot is radially spaced to be relatively moderately coupled due to its travel path. By this arrangement the disk antenna radiates from its periphery to provide a relatively constant background radiating pattern which varies in intensity as the antenna rotates; the first slot alternately functions as a relatively strongly coupled series and shunt radiating slot; and the second slot concurrently alternately functions as a relatively moderately coupled shunt and series radiating slot with each quarter revolution of the disk antenna. The radiation from the periphery of the disk illuminates the regions of the cavity furthest from the center, the first slot illuminates the region midway between the axis rotation and the outer regions, and the innermost slot tends to illuminate the central portion of the cavity.

In a preferred form of the invention the slots are radially positioned an odd multiple of eighth wave lengths away from the axis of rotation to minimize reflected wave interference near the center of the cavity resulting from reflections from the opposite cavity walls.

In a preferred form of the invention each of these slots comprises a rectangular louvered slot having a length approximately $\frac{1}{2}$ wave length. The slots are louvered with a rectangular flange formed along the innermost edge of each slot and extending toward the interior of the wall and away from the axis of rotation of the disk antenna forming an acute angle relative to the plane of the slot. The louvering of the slots serves to increase the vertical field components and change the direction of the microwave energy being radiated from the slots, for improved uniform coupling to the load being heated in the cavity.

BRIEF DESCRIPTION OF THE DRAWINGS

While the novel features of the invention are set forth with particularity in the appended claims, the invention, both as to organization and content, will be better understood and appreciated from the following detailed description taken in conjunction with the drawings in which:

FIG. 1 is a perspective view of a microwave oven illustratively embodying the excitation system of the invention;

FIG. 4 is a top view of a radiating disk antenna illustratively embodying the present invention removed from the oven; and FIG. 5 is a partial cross-sectional view of the disk of FIG. 4 showing the louver configuration for one of the radiating slots.

DETAILED DESCRIPTION

Figure 2:
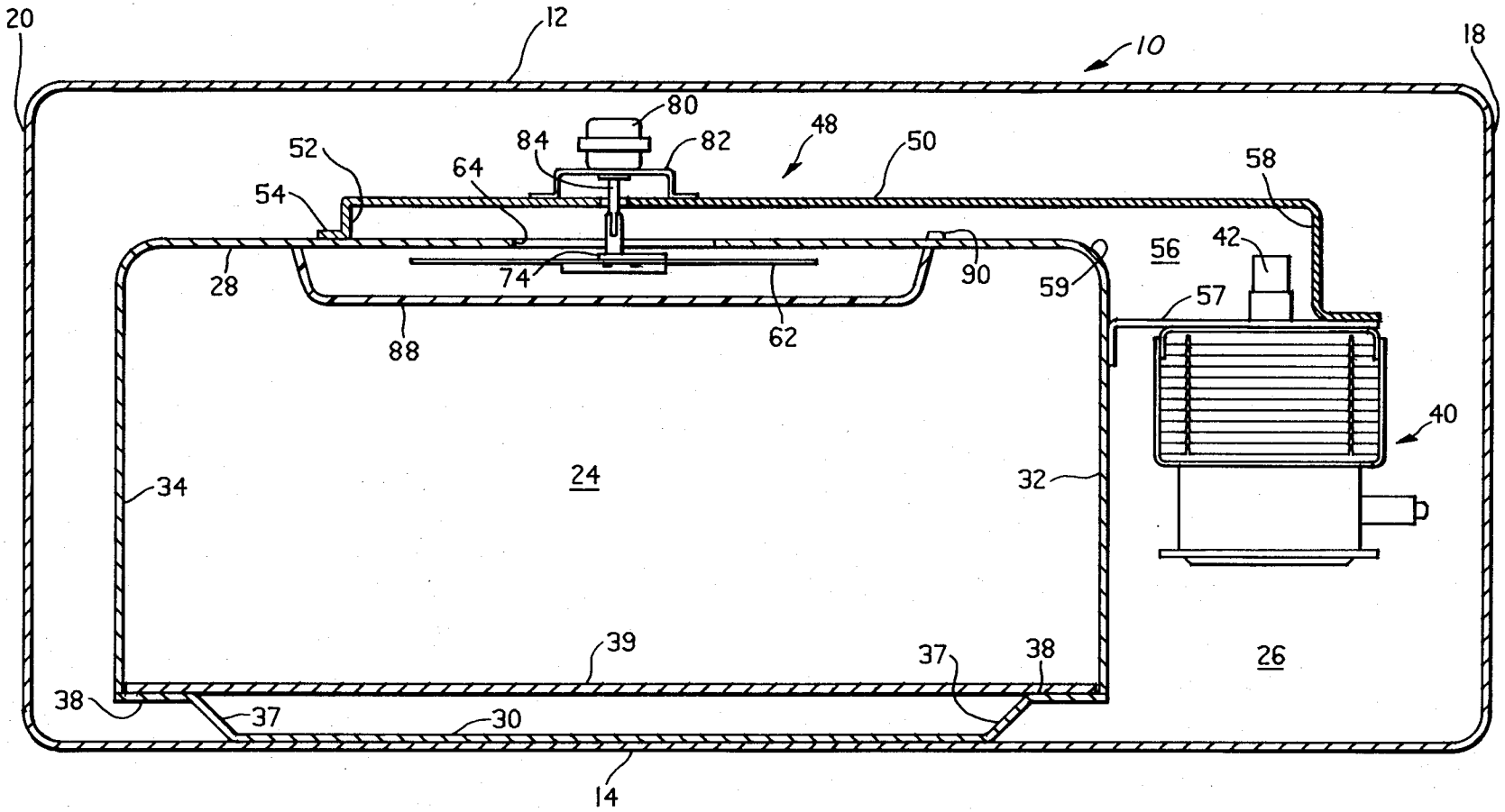
FIG. 2 is a front schematic sectional view of the microwave oven of FIG. 1 taken along lines 2—2.

Referring now to the figures, there is shown a microwave oven designated generally 10. The outer cabinet comprises six cabinet walls including upper and lower walls 12 and 14 and rear wall 16, two side walls 18 and 20 and a front wall partly formed by hingedly supported door 22 and partly by control panel 23. The space inside the outer cabinet is divided generally into a cooking cavity 24 and a controls compartment 26. Cooking cavity 24 includes top wall 28, a bottom wall 30, side walls 32 and 34, the rear cavity wall being cabinet wall 16 and the front cavity wall being defined by the inner face 36 of door 22. Nominal dimensions of cavity 24 are $8\frac{7}{8}$ high by 18" wide by $12\frac{1}{2}$" deep. Bottom wall 30 includes at each side an upwardly tapered portion 37 connecting the main wall portion with raised shelf supporting sections 38 which support shelf 39 approximately $\frac{3}{4}$" above bottom wall 30. Shelf 39 is made of a microwave pervious dielectric material such as that available commercially under the trademark Pyroceram or Neoceram and is disposed in cavity 24 proximate to and substantially parallel to bottom wall 30 to support loads to be heated in cavity 24.

Controls compartment 26 has mounted therein a magnetron 40 which is adapted to produce microwave energy having a center frequency of approximately 2455 megahertz at output probe 42 thereof when coupled to a suitable source of power (not shown) such as the 120 volt AC power supply typically provided at domestic wall receptacles.

The front facing opening of controls compartment 26 is enclosed by control panel 23. It will be understood that numerous other components are required in a complete microwave oven, but for clarity of illustration and description only those elements believed essential for a proper understanding of the present invention are shown and described. Such other elements may all be conventional and as such are well known to those skilled in the art.

The structure of the excitation system in accordance with the present invention as illustratively embodied in microwave oven 10 will now be described. The source of microwave energy is magnetron 40. Microwave energy from magnetron output probe 42 of magnetron 40 is coupled to the cooking cavity 24 via rectangular feed waveguide 48 which extends generally centrally along the upper cavity wall 28. Waveguide 48 is of generally rectangular cross section being formed by member 50 of generally U-shaped cross-section and a portion of top cavity wall 28 which forms a common wall for waveguide 48 and cavity 24. Conductive end wall 52 provides a short circuit termination for waveguide 48 remote from magnetron 40. Member 50 is suitably flanged as at 54 for attachment to top cavity wall 28 by suitable means such as welding. Waveguide 48 is dimensioned to support the $TE_{10}$ propagating mode. Specifically, the width (the dimension running from front to rear of the cavity) is more than $\frac{1}{2}$ but less than 1 guide wave length and the height is less than $\frac{1}{2}$ guide wave length. As used herein, the term guide wave length is defined as the wave length of microwave energy propagating within waveguide 48. In the illustrative embodiment, the height of waveguide 48 is nominally 1" and the width is nominally 3.83". The guide wave length is approximately 6.15".

A microwave energy launching area 56 for energy radiated from magnetron probe 42 is provided by an extension of waveguide member 50 which encloses probe 42 on top and sides. Support flange 57 encloses the bottom of the launch area. Conductive end wall 58 is spaced approximately $\frac{3}{4}$" from probe 42 to provide a launch area short circuit waveguide termination. This spacing is in accordance with magnetron manufacturers recommendation for proper power output and operating characteristics. Launching area 56 is of the same width as waveguide 48 but of height on the order of 2", with the opening end facing curved step 59 formed at the intersection of cavity side wall 32 and top wall 28.

A circular disk antenna member 62 is mounted within cavity 24 for rotation in a plane parallel to upper cavity wall 28. A circular opening 64 to accommodate disk antenna 62 is formed in that portion of the upper cavity wall 28 in common with waveguide 48 having a diameter equal to the width of the waveguide 48. Disk antenna 62 is carried by an integrally molded plastic member designated generally 72 comprising a semi-circular planar base portion 74 and a vertically extending cylindrical central shaft portion 76. Disk antenna 62 is secured to the base portion 74 of support member 72 by polysulfone snap buttons (not shown). An electric drive motor 80 for rotating the disk antenna 62 is mounted to the outer face of the top wall of waveguide 48 by pancake filter/mounting bracket 82. Drive shaft 84 of motor 80 extends through the upper wall of waveguide 48. The vertically extending cylindrical shaft portion 76 of support member 72 has formed therein an upwardly facing blind bore which receives motor shaft 84 to rotatably support disk antenna 62 on shaft 84. A plastic cover 88 enclosing opening 64 and disk antenna 62 attaches to upper cavity wall 28 by resilient tabs 90 which project through small slots in wall 28 annularly distributed about opening 64 for this purpose.

Cover 88 and support member 72 are preferably made of a plastic material having high heat tolerance and low dielectric loss characteristics. A material particularly suitable for support member 72 is the synthetic fluoride resin sold under the trademark of Teflon. Cover 88 is exposed to a lower field intensity from member 72 and hence may be made of a less expensive plastic material such as polypropylene.

In the discussion to follow the disk antenna member and its slot configuration is described in more specific geometric and dimensional detail. It is to be emphasized, however, that the specific dimensions of the illustrative embodiment herein described do not necessarily represent limits of useful values or limitations on the full scope of the invention, but rather are intended to provide direction to those skilled in the art. Similarly, the accompanying explanation of the present understanding of the theory of operation of this invention is provided for the benefit of workers in the art and should not be viewed as limiting the invention described herein to a precise theory of operation.

The diameter and spacing of the disk relative to the cavity wall 28 are selected to enable the disk to radiate microwave energy at its periphery to provide a relatively static pattern of background radiation in the cavity. It has been empirically determined that a disk diameter greater than $1\frac{1}{2}$ free space wave lengths and less than 2 free space wave lengths in combination with a vertical spacing between the disk and cavity wall 28 on the order of 0.2 to 0.3 inches (approximately 0.05 free space wave lengths) will radiate satisfactorily. In the illustrative embodiment a nominal disk diameter of 8 inches (approximately $1\frac{5}{8}$ free space wave lengths) is employed, together with a nominal vertical spacing of 0.25 inches between wall 28 and the disk. These dimensions provide in a planar disk with no slots an impedance match which is close to unity for the cooking cavity of the illustrative embodiment.

However, the peripheral radiation from the disk antenna is the secondary mechanism for coupling energy from the waveguide to the cooking cavity. The primary mechanism for coupling energy into the cavity is provided by two transverse rectangular elongated radiating slots 92 and 94 formed in disk 82. A first slot 92 is oriented substantially transverse to a first radial line 96 extending from the axis of rotation of the disk and laterally centered approximately $\frac{3}{8}$ free space wave lengths from the axis of rotation of the disk. Second slot 94 is oriented transverse to a second radial line 98 extending from the axis of rotation of disk at an angle of 90° relative to the first radial line. This slot is laterally centered on the second radial line at a distance of approximately $\frac{1}{8}$ free space wave length from the axis of rotation. Each slot is provided with a louver comprising a rectangular flange 100 formed along the innermost edge of each of the slots extending away from the axis of the slot and toward the interior of cavity 24 forming an acute angle relative to the plane of the slot.

Figure 3:
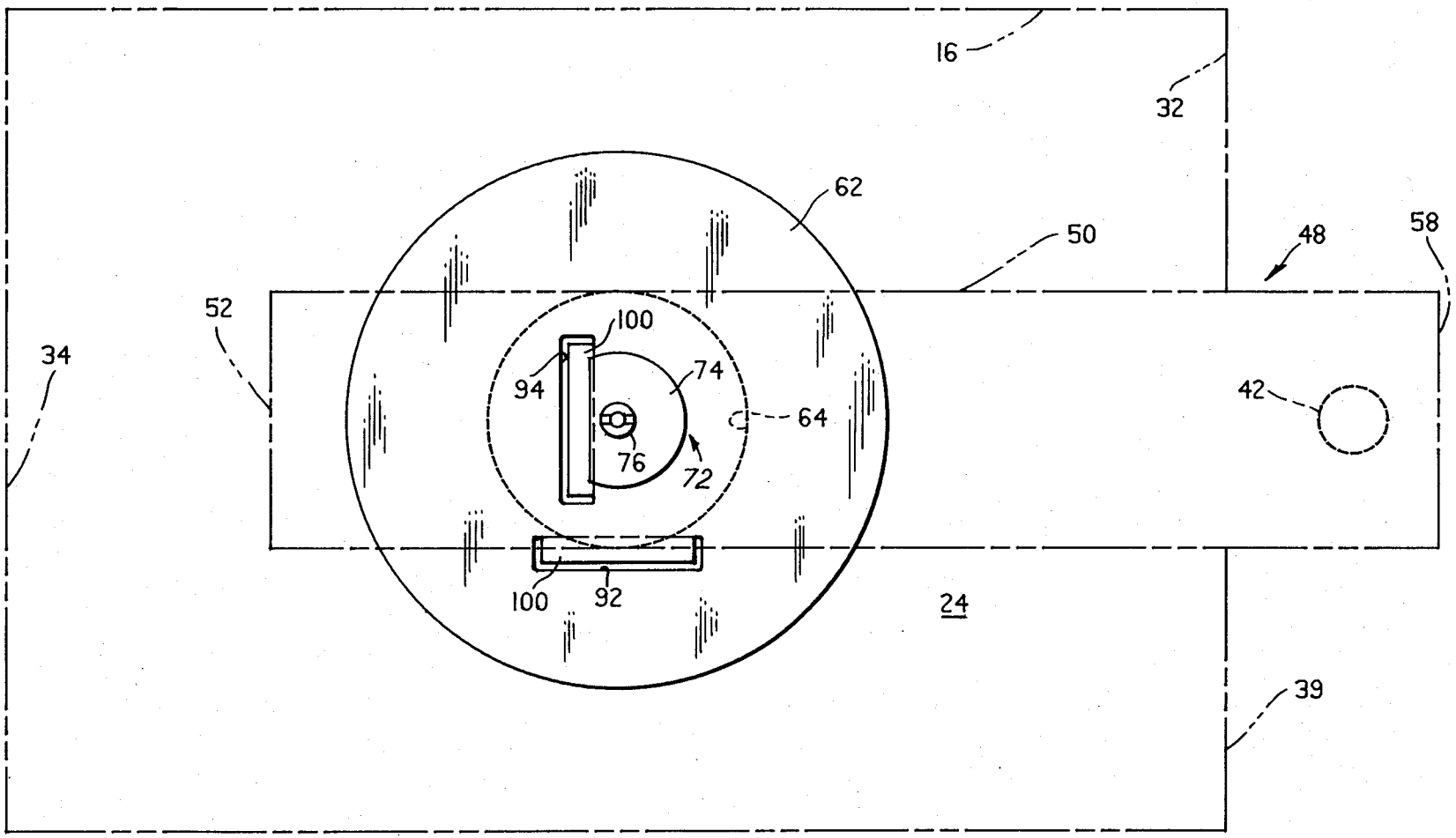
FIG. 3 is a partial top view of the oven of FIG. 1 with portions removed to show structural details of the waveguide and radiating disk antenna mounting.

By this arrangement first and second slots 92 and 94 are oriented to function as shunt and series slots respectively when the longitudinal axis of the first slot is aligned parallel to the longitudinal axis of the waveguide (as shown in FIG. 3) and to function as series and shunt slots respectively when the longitudinal axis of the first slot is aligned perpendicular to the longitudinal axis of the waveguide.

The location of the slots at roughly an odd multiple of $\frac{1}{8}$ free space wave length (approximately $\frac{3}{8}$ wave length for slot 92 and $\frac{1}{8}$ wave length for slot 94) from the axis of rotation which is laterally centrally positioned relative to the cavity side walls insures that the reflected energy arriving at the slots from one wall is roughly $\frac{1}{4}$ free space wave length out of phase with energy reflected from its opposing side wall. This minimizes destructive interference near the center of cavity 24 preventing a cold spot in the center.

The longitudinal distance of end wall 52 relative to magnetron probe 42 and relative to the axis of rotation are selected with a view to proper impedance matching and good coupling of energy from the waveguide to the slots in disk 82. For optimum coupling to the slots, the axis of rotation should be closely proximate a maximum waveguide field point so that the slots are positioned proximate a maximum field point when aligned as shunt slots.

In the illustrative embodiment end wall 52 is positioned 15.80 inches from magnetron probe 42 and 4.61 inches from the axis of rotation of disk antenna 62. Slot 92 is located at a radial distance of approximately 2 inches from the axis of rotation. Hence, when slot 92 is aligned as a series slot it is located approximately 2.6 inches from the waveguide short circuit 52 at its closest position and 6.6 inches at its most remote position, each of which is proximate (within 0.5 inches) to a minimum waveguide field point which points exist at distances equal to multiples of half-guide wave lengths (approximately 3.1 inches) from the short circuit termination of waveguide 48. Similarly, when aligned as a shunt slot the slots are approximately positioned 4.61 inches from the waveguide short circuit termination which is closely proximate the maximum field point which occur $\frac{3}{4}$ guide wave lengths from the short circuit termination for near optimum coupling from waveguide to slot in each orientation. The inner slot 94, due to its proximity to the axis of rotation region of the waveguide 48, is moderately coupled regardless of the angular position of the disk antenna. The result is that on a time average basis the outer slot is the dominant slot being more closely coupled for all angular positions of the disk antenna than the inner slot. In the illustrative embodiment each slot is $2\frac{1}{2}''$ long by $\frac{1}{2}''$ wide with a 0.375″ louver extending downwardly from the disk a vertical distance of 0.14 to 0.16 inches measured from the plane of the disk to the tip of the lowermost edge of flange 100.

An additional advantage provided by this antenna arrangement of this invention is that the axis of rotation may be located at the maixmum field point (approximately $\frac{3}{4}$ guide wave lengths from the guide short circuit positioned defined by end wall 52) and no additional cavity or waveguide tuning is required for proper impedance matching.

It has been empirically determined that this combination of background radiation from the periphery of the disk combined with the dynamic radiation provided by the rotating slots with the outer slot illuminating the intermediate region of the oven, the inner slot illuminating the center portion of the cavity, and the radiation from the periphery of the disk illuminating the outermost regions of the cavity provides significantly improved cooking performance over that provided by the single slot arrangement of the Miller design (U.S. Pat. No. 4,463,239) or the use of a simple unslotted disk. This is believed due in part to the varying radiation from these slots with rotation of the disk as the slots move between their shunt and series positions, resulting in time varying radiation pattern in the cavity, and the relatively static or constant radiation pattern for energy propagating from the periphery of the disk which varies in intensity as the disk rotates as the distribution of energy from the waveguide varies between the peripheral radiation and slot radiation due to the changing impedance presented by the slots during each rotation. Also, the louvering of the slots provides enhanced cooking performance over that of planar slots. It is thought that the louvers increase the vertical field components of the energy radiating from the slots, resulting in better coupling to the load.

While in accordance with the Patent Statutes, a specific embodiment of the present invention has been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A microwave oven comprising:

a cooking cavity defined by electrically conductive walls;

a rectangular feed waveguide extending along the outer surface of one of said cooking cavity walls, one wall of said waveguide being common with at least a portion of said one wall of said cooking cavity, said common wall having formed therein a circular opening laterally centrally positioned relative to said cavity;

a microwave energy generator coupled to said waveguide to establish a microwave energy propagating mode therein; said waveguide including a short circuit termination remote from said generator beyond the circular opening;

a circular metallic radiating disk antenna mounted in said cavity for rotation in a plane parallel to said common wall having an axis of rotation coaxially aligned with the circular opening, said disk antenna being configured to radiate energy peripherally from the outermost edge of said disk antenna;

means for rotating said disk antenna;

said disk having formed therein two elongated radiating slots, a first one of said slots being oriented substantially perpendicular to a first radial line extending from said axis of rotation of said disk antenna and a second one of said slots being oriented substantially perpendicular to a second radial line extending from said axis of rotation at an angle of 90° relative to said first radial line, said first slot being radially positioned outwardly of said second slot at a distance selected for relatively strong coupling to energy propagating in said waveguide and said second slot being positioned for relatively moderate coupling to the waveguide energy; each of said slots being louvered for improved coupling of microwave energy to the load being heated in said cavity.

2. The microwave oven of claim 1 wherein said disk antenna has a diameter in the range of $1\frac{1}{2}$ to 2 free space wave lengths, and vertical spacing relative to said common wall on the order of 0.05 free space wave lengths.

3. The microwave oven of claim 2 wherein said first slot is radially positioned approxirately $\frac{3}{8}$ free space wave length from said axis of rotation and said second slot is radially positioned approximately $\frac{1}{8}$ free space wave length from the said axis of rotation.

4. The microwave oven of claim 1 wherein said first slot is radially positioned approximately $\frac{3}{8}$ free space wave length from said axis of rotation and said second slot is radially positioned approximately $\frac{1}{8}$ free space wave length from the said axis of rotation.

5. The microwave oven of claim 1 wherein said louvered slots each comprise a rectangular flange formed along the innermost edge of the slot, said flange extending toward the cavity interior and away from said axis of rotation forming an acute angle relative to the plane of the slot,

6. A microwave oven comprising:

a cooking cavity defined by electrically conductive walls;

a rectangular feed waveguide extending along the outer surface of one of said cooking cavity walls, one wall of said waveguide being common with at least a portion of said one wall of said cooking cavity, said common wall having formed therein a circular opening laterally centrally positioned relative to said cooking cavity;

a microwave energy generator coupled to said waveguide to establish a microwave energy propagating mode therein; said waveguide including a short circuit termination remote from said generator beyond the circular opening, said short circuit termination being positioned to establish a maximum field point proximate to the center of said circular opening;

a circular metallic radiating disk antenna mounted in said cavity for rotation in a plane parallel to said common wall, said disk antenna having an axis of rotation coaxially aligned with the circular opening having a diameter in the range $1\frac{1}{2}$ to 2 free space wave lengths, and a vertical spacing relative to said common wall sufficient to permit energy propagation therebetween whereby energy radiates peripherally from the outermost edge of said disk antenna;

means for rotating said disk antenna;

said disk having formed therein two elongated radiating slots, a first one of said slots being oriented substantially perpendicular to a first radial line extending from said axis of rotation of said disk antenna, the longitudinal center line of said first slot intersecting said radial line at a distance of approxiamtely a first odd multiple of $\frac{1}{8}$ free space wave lengths from said axis of rotation, a second one of said slots being oriented substantially perpendicular to a second radial line extending from said axis of rotation at an angle of 90° relative to said first radial line, the longitudinal center line of said second slot intersecting said second radial line at a distance of approximately a second odd multiple of $\frac{1}{8}$ free space wave lengths from said axis of rotation, said second multiple being less than said first multiple, said first slot being oriented to function as series slot laterally positioned to pass in close proximity to minimum waveguide field points when said first slot is aligned perpendicular to the longitudinal axis of said waveguide and function as shunt slot laterally positioned to pass in close proximity to maximum waveguide field points when said first slot is aligned parallel to the longitudinal axis of said waveguide, said second slot being laterally positioned to remain in relatively close proximity to a maximum waveguide field point as said antenna rotates;

whereby said disk antenna radiates from its periphery to provide a relatively static background radiating pattern which varies in intensity as the antenna rotates and said first slot alternately functions as a strongly coupled series and shunt slot and said second slot functions as a moderately coupled shunt and series slot with each quarter revolution of said disk antenna to provide a dynamic radiating pattern as said antenna rotates.

7. The microwave oven of claim 6 wherein each of said slots comprises a rectangular slot having a length of approximately $\frac{1}{2}$ wave length and a width of less than 0.10 wave length.

8. The microwave oven of claim 7 wherein said slots are louvered to increase the vertical electric field component of the energy radiated from said slots for improved coupling to the load being heated in the oven.

9. The microwave oven of claim 8 wherein said louvered slots each comprise a rectangular flange formed along the innermost edge of the slot, said flange extending toward the cavity interior and away from said axis of rotation forming an acute angle relative to the plane of the slot.

10. The microwave oven of claim 6 wherein said slots are louvered to increase the vertical electric field component of the energy radiated from said slots for improved coupling to the load being heated in the oven.

11. The microwave oven of claim 10 wherein said louvered slots each comprise a rectangular flange formed along the innermost edge of the slot, said flange extending toward the cavity interior and away from said axis of rotation forming an acute angle relative to the plane of the slot.

* * * * *